United States Patent [19]

Densmore

[11] 4,286,523

[45] Sep. 1, 1981

[54] SYSTEM FOR SUPPORTING OVERHEAD TROLLEY RAIL

[75] Inventor: Neal W. Densmore, Franklin, Pa.

[73] Assignee: Voy Manufacturing Co., Pittsburgh, Pa.

[21] Appl. No.: 74,688

[22] Filed: Sep. 12, 1979

[51] Int. Cl.[3] ..... E01B 25/24

[52] U.S. Cl. ..... 104/111; 104/93; 105/150

[58] Field of Search ..... 4/302; 104/93, 89, 111, 104/115; 414/564, 678; 105/150

[56] References Cited

U.S. PATENT DOCUMENTS

| | | | |
|---|---|---|---|
| 1,128,909 | 2/1915 | Sheridan | 104/111 |
| 1,592,814 | 7/1926 | Harris | 104/111 |
| 1,846,178 | 2/1932 | Berfren | 104/111 |
| 3,219,199 | 11/1965 | Lagerstrom | 104/111 |
| 3,837,609 | 9/1974 | Weiss et al. | 104/111 |
| 4,116,134 | 9/1978 | Troth | 104/111 |

*Primary Examiner*—Richard A. Bertsch

*Attorney, Agent, or Firm*—Thomas H. Murray; Arnold B. Silverman

[57] ABSTRACT

A system for supporting an overhead trolley rail which requires a minimum of simple parts and wherein the trolley rail is supported from washer-like elements each having a centrally-disposed opening therein and at least one curved portion depending downwardly from the element. A bolt extends across the curved portion and supports two L-shaped keepers each having one leg through which its associated bolt extends and a second leg which underlies a flange on a trolley rail, which in most cases comprises an I-beam. A single roof bolt extends through the centrally-disposed opening of the washer-like element and into a mine roof or the like, the single roof bolt comprising the sole support for the washer-like element.

10 Claims, 8 Drawing Figures

SYSTEM FOR SUPPORTING OVERHEAD TROLLEY RAIL

BACKGROUND OF THE INVENTION

While not limited thereto, the present invention is particularly adapted for use with overhead trolley rails used in mines and the like to support a suspended conveyor system. In a mine, clearance and headroom are limited, lighting is dim, the mine roof structure may be flawed or uneven, the equipment being handled is generally heavy and cumbersome and, in general, working conditions are quite adverse. In the past, such overhead trolley rails for mine applications typically have been formed from weldments comprising lateral plates welded to the top flange of an I-beam, each lateral plate having two holes drilled therein to receive roof bolts. This construction requires each length of rail to be jacked against the mine roof and held in place while the roof is drilled and the bolts inserted through the holes in the lateral plates and into the drilled holes in the roof. As those skilled in the art will appreciate, a system of this sort is expensive in construction and difficult to install. Furthermore, to retrieve a rail and replace it, the bolts must be pulled or, in the case of resin bolts, cut off. Other prior art trolley rail support systems for mines and other applications are shown, for example, in U.S. Pat. Nos. 1,033,395; 1,577,394; 1,592,814; 1,846,178; 3,219,199; 4,166,134 and U.S. Pat. No. Re. 17,629. U.S. Pat. No. 1,033,359 discloses a rail system which employs two independent hangers for the rail, each of which is secured to an overhead support by a separate bolt. U.S. Pat. No. 1,577,394 shows a system wherein a single bolt secures a bracket to an overhead support, but the bracket must be secured to an I-beam rail by two bolts which extend through two holes which must be drilled in a flange of the I-beam. U.S. Pat. No. 1,592,814 discloses a relatively complex suspension system employing a split trolley rail. U.S. Pat. No. 1,846,178 is directed to a suspension system which requires four separate bolts to secure a rail to a hanger. Each of these bolts must be tightened separately to install the rail. U.S. Pat. No. 3,219,199 discloses a trolley hanger for mine installations which does employ a single roof bolt for each hanger, but wherein brackets carried at the bottoms of each bolt must be slipped over an end of an I-beam flange. That is, the brackets are integral one-piece elements which cannot be separated from the rail without slipping them over an end of that rail. Finally, U.S. Pat. No. 4,166,134 employs two bolts secured to an overhead support in combination with a complex system for securing the rail to a bracket. Some of the foregoing systems are unsuitable for mine environments; and those which are intended for use in mines are cumbersome and not altogether satisfactory.

SUMMARY OF THE INVENTION

In accordance with the present invention, a new and improved system is provided for supporting an overhead trolley rail which is simpler and which requires fewer parts than prior art systems, particularly fewer roof bolts. At the same time, the system makes it easier to install the rail in a mine since the rail sections need not be jacked against the roof during the drilling and bolting operations. Instead of welding lateral plates onto the I-beam flange as in prior art installations, roof hanger assemblies having washer-like elements can be secured to the mine roof by a single roof bolt rather than two roof bolts as was required with the prior art welded flange system. At least one curved portion depends downwardly from the washer-like element and, in one embodiment of the invention, forms an upwardly-facing hook. These hooks receive transverse bolts which carry at their opposite ends L-shaped keepers each having one leg through which an associated bolt extends and a second leg which underlies a flange on a trolley rail. In this way, the washers can be bolted to the roof and the rail sections then suspended from the roof hanger assemblies. By tightening the bolt on which the keepers are carried, the keepers can be drawn into tight, abutting relationship with the upper flange of the I-beam rail.

By placing a single roof bolt directly over the rail, two bolts straddling the rail are not necessary for stability in many instances. Furthermore, one bolt at each rail joint holds both of the adjacent rail ends in position. This results in a three-to-one reduction in the total number of roof bolts required, a 66% reduction in bolt costs and drilling expense, and a large reduction in total time required to place the rail. Furthermore, the system of the invention utilizes plain I-beams, a decided savings over the weldments previously employed.

The above and other objects and features of the invention will become apparent from the following detailed description taken in connection with the accompanying drawings which form a part of this specification, and in which.

Figure 1:
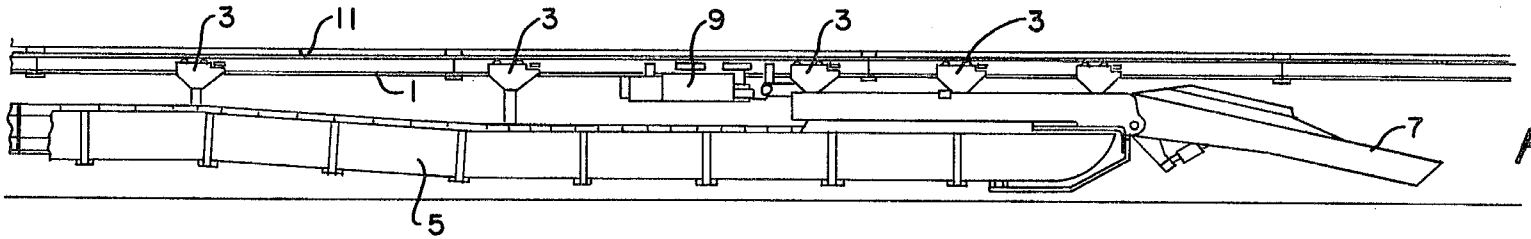
FIG. 1 illustrates a typical trolley rail mine installation with which the present invention may be used.

With reference now to the drawings, and particularly to FIG. 1, the present invention is concerned with new and improved means for suspending an overhead trolley rail 1 from a mine roof 11 or the like. As will be seen hereinafter, the trolley rail 1 is formed from I-beam sections which carry, on their lower flange, wheeled carriages 3 from which is suspended a haulage conveyor 5. The conveyor 5 may be a chain-driven pan or belt conveyor with a flexible frame that permits it to negotiate horizontal turns as it moves along the trolley rail. A conveyor extends from a panel belt entry to follow a continuous miner into each working place and provides continuous coal haulage from the miner to the panel belt. The coal is then conveyed on entry conveyor 7 to the pan conveyor 5 from whence it is conveyed to a panel belt conveyor which conveys the coal to the mouth of the mine. As the continuous miner advances in the mine, the conveyor 5 can be advanced along with it by means of a trolley tractor 9 which propels the entire conveyor 5 along the trolley rail 1. It will be understood, of course, that while the invention is particularly adapted for use in trolley rails for conveyors of this type, it can also be used in other applications where an overhead trolley rail is required.

Figure 4:
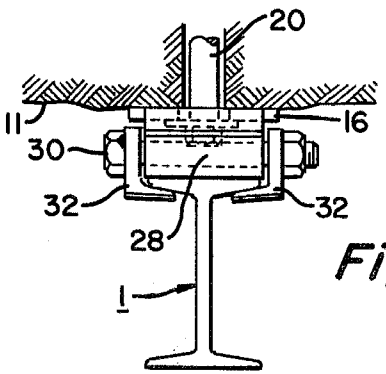
FIG. 4 is an end view of the embodiment of the invention shown in FIG. 2.
Figure 2:
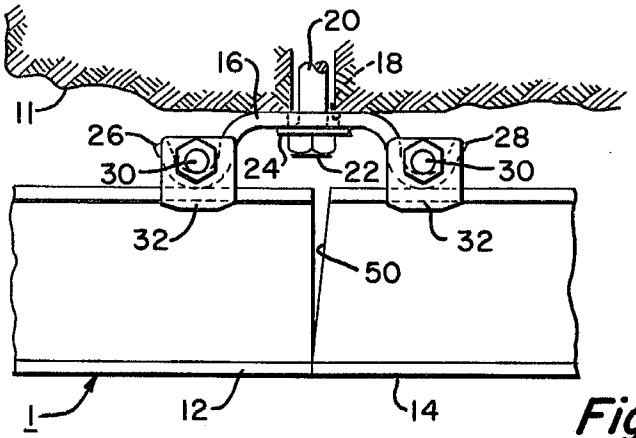
FIG. 2 is an elevational view of one embodiment of the invention.
Figure 3:
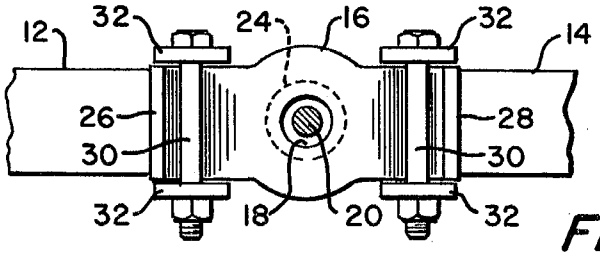
FIG. 3 is a top view of the embodiment of the invention shown in FIG. 2.

With reference to FIGS. 2–4, the mine roof is again indicated generally by the reference numeral 11. The trolley rail 1 itself comprises I-beam sections 12 and 14 arranged in end-to-end abutting relationship as shown in FIG. 2. Each of these sections, for example, may be about ten feet in length. The means for supporting the trolley rail comprises a plurality of hanger assemblies, only one of which is shown in FIGS. 2–4. It comprises a stamped or forged washer-like element 16 having a central aperture or opening 18 therein through which a mine roof bolt 20 extends. The bolt has a head 22 and an integral washer 24 of larger diameter than the opening 18 such that the washer-like element 16 is held securely to the underside of the mine roof 11 when the bolt is inserted in place and tightened.

Depending downwardly from the washer-like element 16 are diametrically-opposite curved portions in the form of upwardly-facing hook members 26 and 28. These are displaced along the axis of the rail sections from the central aperture 18. The hook members 26 and 28, in turn, receive transverse bolts 30 each provided with L-shaped keeper members 32 (FIG. 4) at its opposite ends. Each keeper member has a vertical leg through which its associated bolt 30 extends and a second leg which underlies a flange on the I-beam trolley rail. By tightening the nut on the bolt 30, the keeper members 32 can be drawn into snug abutting relationship with the underside of the upper flange on the trolley rail to secure it in place. In the tightening process, the top of the upper I-beam flange is wedged against the underside of a curved portion 26 or 28; however the curvature permits the rail to accommodate an uneven mine roof condition.

Figure 5:
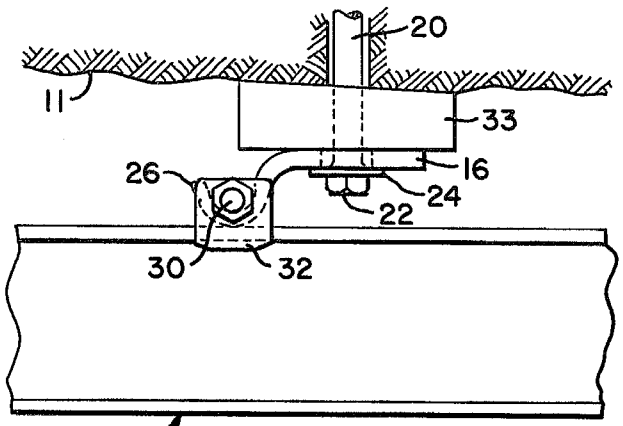
FIG. 5 is a side elevational view of an alternative embodiment of the invention employing only a single depending curved portion.

The arrangement shown in FIGS. 2 and 3 is particularly adapted for use in supporting the ends of I-beam sections 12 and 14 forming the trolley rail. These sections, as mentioned above, are normally about ten feet long and require support intermediate their ends. An arrangement for intermediate support is shown in FIG. 5 wherein elements corresponding to those of FIGS. 2–4 are identified by like reference numerals. In this case, however, the washer-like element 16 has only one hook member 26. Aside from this, an arrangement is the same; however, it will be appreciated that if desired, two hooks such as that shown in FIG. 2 can be utilized for the midspan support. In FIG. 5, it will be noted that a shim 33 is inserted between element 16 and the mine roof 11 to accommodate an uneven roof condition.

Figure 6:
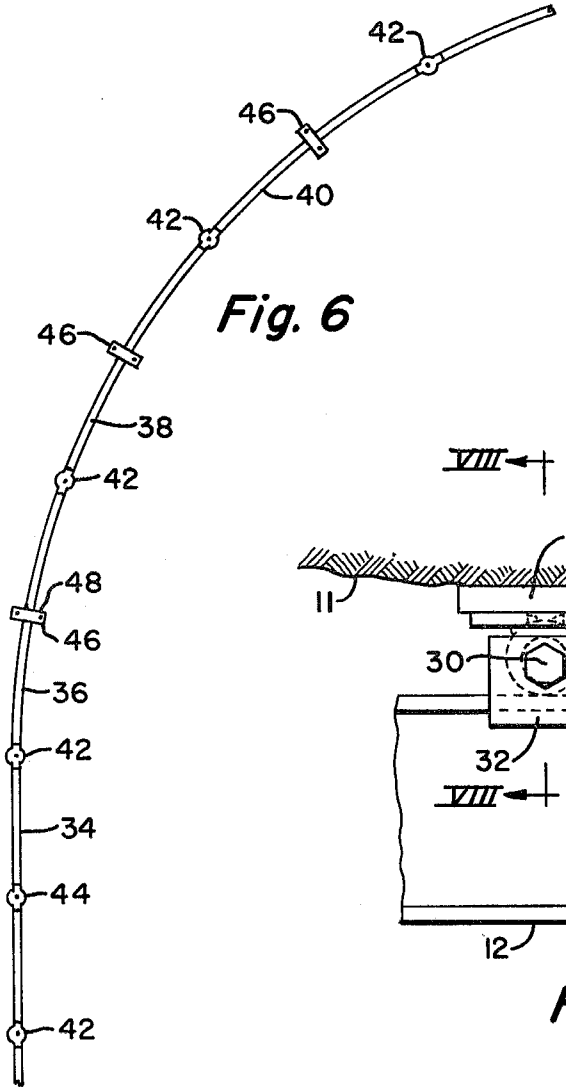
FIG. 6 illustrates the manner in which the overhead trolley rail suspension system of the invention may be formed into a curve.

In FIG. 6, a series of I-beam trolley rail sections 34, 36, 38 and 40 is shown in a curved configuration terminating in a straight section (i.e., section 34). The abutting ends of the sections 34–40 are supported by a hanger assembly such as that shown in FIG. 2, these being identified by the reference numeral 42 in FIG. 6. Intermediate the ends of the straight section 34 is a single hook hanger assembly 44 such as that illustrated in FIG. 5. However, and while it is not absolutely necessary, it is desirable on the curved portion of the trolley rail to provide plates 46 intermediate the hanger assemblies 42. The plates 46 can be secured to the trolley rail in the manner shown in FIG. 2 or FIG. 5, for example, but are provided with two holes or openings 48 through which two roof bolts extend to give the rail greater support along the curved portion.

With reference again to FIG. 2, it can be seen that because of the curved nature of the hook members 26 and 28, the two rail sections 12 and 14 can be misaligned as permitted by a beveled end 50 on one rail. This enables individual rail sections to be inclined upwardly or downwardly when suspended from an uneven mine roof.

Figure 8:
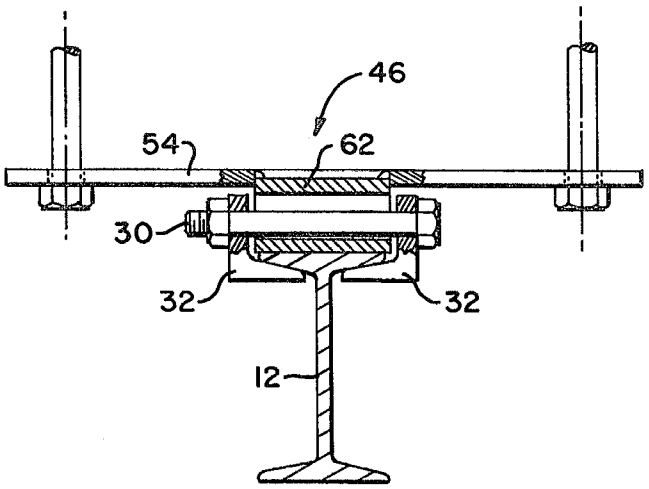
FIG. 8 is a cross-sectional view taken substantially along line VIII—VIII of FIG. 7.
Figure 7:
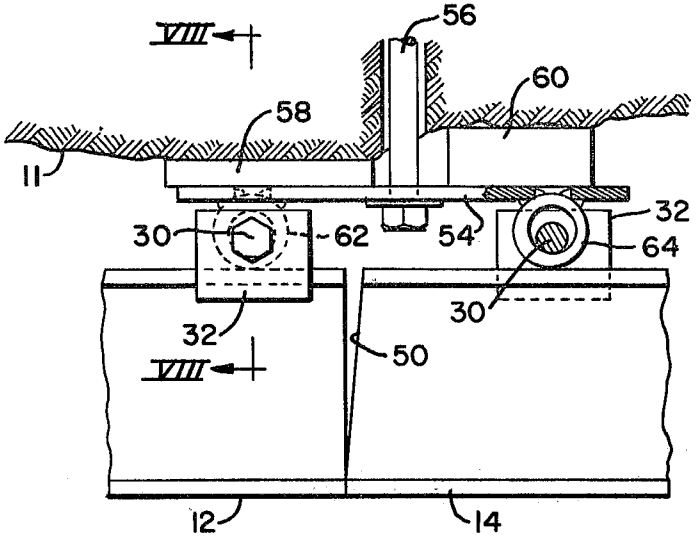
FIG. 7 is a side elevational view of an alternative embodiment of the invention wherein tubular elements are employed rather than hooked members.

In FIG. 7, another embodiment of the invention is shown which again includes a central washer-like member 54 having an opening through which a roof bolt 56 extends. In the illustration of FIG. 7, shims 58 and 60 are inserted between the upper surface of the element 54 and the mine roof 11 to compensate for an uneven condition. In this case, instead of using hooked members, tubular members 62 and 64 are welded to the washer-like member 54 and receive bolts 30 corresponding to those shown in FIGS. 2–4. Aside from this, the construction is the same as that shown in FIGS. 2–4 with the tubular elements 62 and 64 permitting misalignment between rails sections 12 and 14 as described above. The embodiment of FIG. 7 can also be used for mid-rail support as in FIG. 6 with the use of two bolts as shown in FIG. 8.

To install the trolley rail, it is necessary only to secure the hanger assemblies to the mine roof, followed by insertion of the individual rail sections 12 and 14, for example, between the keepers 32. The nuts on bolts 30 are then tightened to secure the sections in place. If it should become necessary to replace any section, it is only necessary to loosen the nuts on the bolts 30, remove the section, and insert a new section followed by tightening of the nuts on bolts 30. Alternatively, the support assembly can be positioned on the end of a rail section and the rail then positioned and held in place while the bolt hole is drilled through the opening provided in the assembly.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A system for supporting an overhead trolley rail from a mine roof or the like, comprising a washer-like element having a centrally-disposed opening therein, at least one curved portion depending downwardly from the washer-like element, a bolt extending across said curved portion and supported thereby, two L-shaped keepers at the ends of said bolt each having one leg through which its associated bolt extends and a second leg which underlies a flange on a trolley rail, and a single roof bolt extending through said centrally-disposed opening and into a mine roof or the like, said single roof bolt comprising the only support for said washer-like element.

2. The system of claim 1 wherein said trolley rail comprises an I-beam and the second leg of each keeper underlies the upper flange of said I-beam, and a nut threaded onto one end of said bolt to draw said keepers into close abutting relationship with the underside of said flange.

3. The system of claim 1 wherein said washer-like element is provided with diametrically-opposite curved portions depending downwardly from the washer-like element, each curved portion serving to support an associated bolt and two L-shaped keepers.

4. The system of claim 3 wherein the diametrically-opposite curved portions are in the form of upwardly-facing hooks each of which receives an associated bolt.

5. The system of claim 3 wherein said diametrically-opposite curved portions are in the form of tubular members through which said bolts extend.

6. The system of claim 4 or 5 wherein the L-shaped keepers for each curved portion serve to support the ends of axially-aligned trolley rails.

7. The system of claim 1 wherein the associated bolt of each said pair of keepers includes means for drawing said pair of keepers together to wedge the flange of said rail into abutment with said curved portion.

8. The system of claim 7 wherein said curved portion accommodates abutting contact with the flange of said rail throughout a range of angular positions with respect thereto in a vertical plane intersecting the axis of said rail.

9. A system for supporting an overhead trolley rail from a mine roof or the like comprising a washer-like member secured to the mine roof and having at least one curved portion depending downwardly from the washer-like member, keeper means supportingly engageable with the rail, securing means cooperable with said keeper means and said curved portion for supporting said rail on the washer-like member, said keeper means having a pair of generally L-shaped keepers for each said curved portion, each said keeper having an axial extent oriented generally parallel to said rail, each said keeper having a leg in underlying supporting relationship with respect to a portion of said rail, said securing means including at least one elongated bolt oriented generally transversely with respect to said rail and securing two said keepers to a said curved portion, and said securing means cooperates with said curved portion to permit the rail to assume an angle with respect to the plane of said washer-like member.

10. The system of claim 9 including a single roof bolt securing said washer-like member to the mine roof.

* * * * *

UNITED STATES PATENT AND TRADEMARK OFFICE

CERTIFICATE OF CORRECTION

PATENT NO. : 4,286,523

DATED : September 1, 1981

INVENTOR(S) : NEAL W. DENSMORE

It is certified that error appears in the above-identified patent and that said Letters Patent are hereby corrected as shown below:

On the Title Page, the Assignee should read --Joy Manufacturing Co.--

Column 3, line 4, "applications" should be --installations--.

Column 3, line 49, "an arrangement" should read --the arrangement--.

Signed and Sealed this

*Eighteenth* Day of *May 1982*

[SEAL]

*Attest:*

GERALD J. MOSSINGHOFF

*Attesting Officer*

*Commissioner of Patents and Trademarks*